US006955456B2

(12) United States Patent
Schroeder

(10) Patent No.: US 6,955,456 B2
(45) Date of Patent: Oct. 18, 2005

(54) ILLUMINATED POLE-SUSPENDED FLAG AND METHOD OF ILLUMINATING

(76) Inventor: Karl S. Schroeder, 6822 Salem Ave., Clayton, OH (US) 45315

( * ) Notice: Subject to any disclaimer, the term of this patent is extended or adjusted under 35 U.S.C. 154(b) by 130 days.

(21) Appl. No.: 10/403,141

(22) Filed: Apr. 1, 2003

(65) Prior Publication Data

US 2003/0193804 A1 Oct. 16, 2003

Related U.S. Application Data

(60) Provisional application No. 60/371,565, filed on Apr. 11, 2002.

(51) Int. Cl.[7] ..... F21S 13/10

(52) U.S. Cl. ..... 362/431; 362/223; 362/253

(58) Field of Search ..... 362/431, 223, 362/253; 40/541, 502, 601, 603, 604

(56) References Cited

U.S. PATENT DOCUMENTS 3,890,497 A * 6/1975 Rush ..... 362/473
4,163,426 A * 8/1979 O'Neill ..... 116/28 R
5,988,100 A * 11/1999 Schmitt ..... 116/173
6,129,035 A * 10/2000 Schweinberger ..... 116/28 R

FOREIGN PATENT DOCUMENTS

DE 3918169 * 8/1990 ..... F21V/33/00

* cited by examiner

*Primary Examiner*—John Anthony Ward
*Assistant Examiner*—Mark Tsidulko
(74) *Attorney, Agent, or Firm*—William Weigl

(57) ABSTRACT

To enable legal twenty-four hour national flag display, to permit night display of vehicle-mounted school and team flags, and to do either with minimal increase in night sky light pollution, I mount a light source immediately adjacent a flag and direct the light essentially directly toward the flag, rather than upwardly into the sky. Preferably, the light source is provided within a transparent portion of the flag-mounting pole, and is ideally focused directly toward the flag by a reflector which is adapted to shift positions with changes in flag positions due to directional changes of air flow across the flag.

8 Claims, 2 Drawing Sheets

FIG. 5
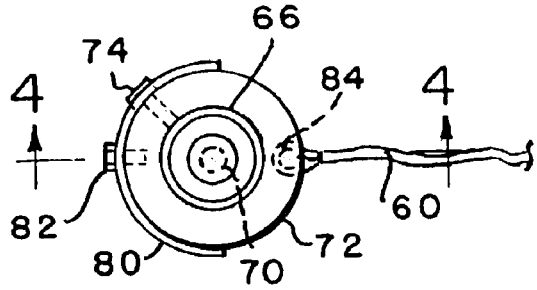
FIG. 3
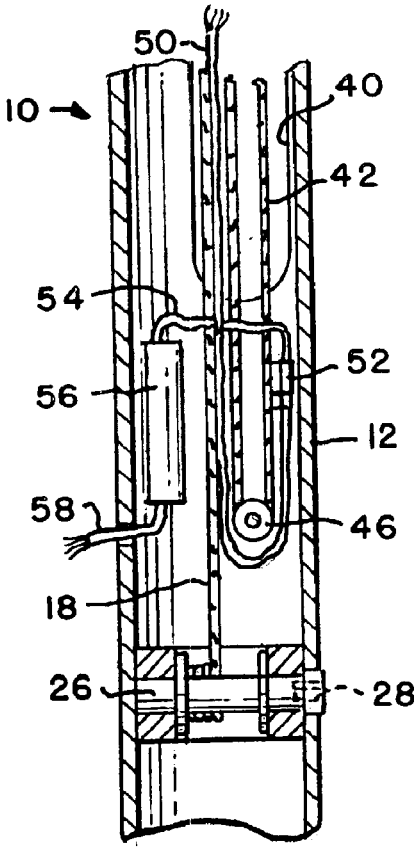
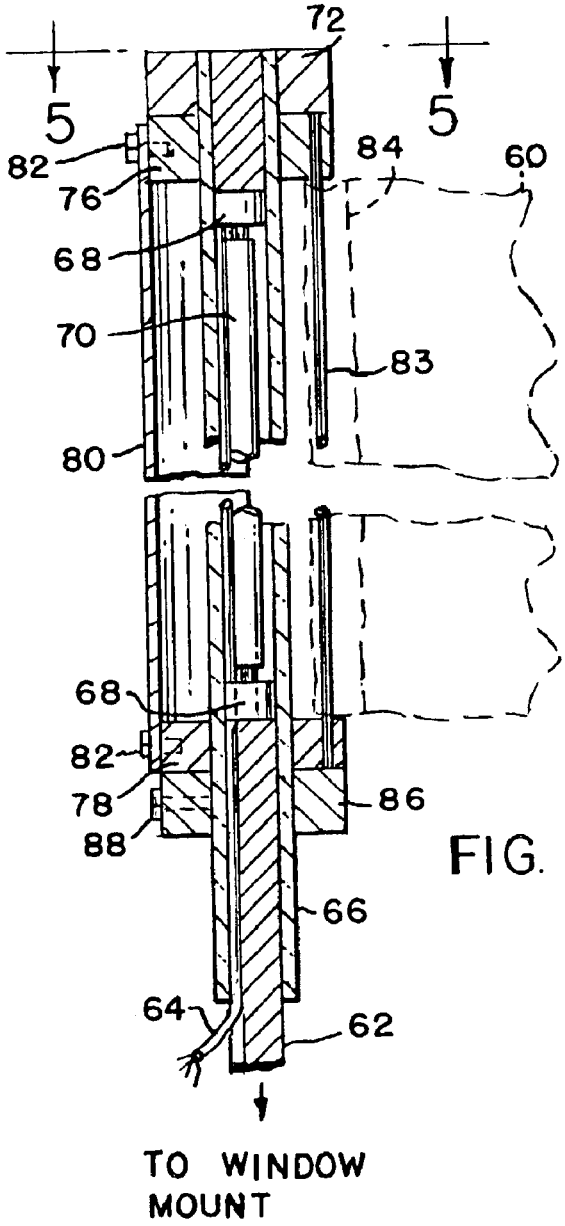
FIG. 4

ILLUMINATED POLE-SUSPENDED FLAG AND METHOD OF ILLUMINATING

This application is based on U.S. Provisional Patent Application Ser. No. 60/371,565 filed Apr. 11, 2002.

This invention relates to flag illumination from immediately adjacent a flag under night or low light conditions, whether such flag is mounted on a stationary flagpole, on a moving vehicle or is hand carried.

BACKGROUND OF THE INVENTION

Chapter 10 of Title 36 of the United States Code recommends American flag display only from sunrise to sunset. However, it also states that American flags "may be displayed twenty-four hours a day if properly illuminated during hours of darkness". Flags, particularly national flags and team or school flags, represent a source of pride to those who display them. University flags are frequently quite prominently exhibited on vehicles traveling to and from major sporting events of the school. It is fair to assume that if school flags could be easily and inexpensively lit up after dark, many would opt for the added feature.

Pole-mounted flags present a not-insignificant problem of atmospheric light pollution when the flag is on a tall pole or flagstaff and one or more spotlights at ground level are focused on the flag area surrounding 360 degrees at the top of the pole. According to the International Dark-Sky Association, over one billion dollars is wasted annually to generate light that does nothing more than light up the sky unnecessarily, and create problems while doing so. It is estimated that almost one third of the light created out-of-doors escapes into the night sky where, instead of providing useful illumination, it causes glare, sky glow and other types of light pollution. According to the Dark-Sky Association, about 2,500 individual stars should normally be visible on a clear night in an unpolluted sky, but in a typical suburb, only 200 to 300 may be visible. In a city, fewer than a dozen stars may shine through an artificially lit sky.

While the most common causes of light pollution are street lights, security lights, billboards lit from below, landscape illumination directed upwardly, businesses like convenience stores and gas stations that operate under extremely high levels of illumination, spot lights trained on night-lit flags also contribute to some extent to the overall problem. To combat this, many municipalities and communities, especially those in areas of research observatories, have responded to the urging of astronomers and have enacted ordinances for the regulation of night lighting. Additionally, at the request of wildlife environmental groups, some of Florida's oceanfront communities have adopted lighting codes to protect nesting sea turtles along beaches. These and other problems were taken into account in the development of the present invention. It will be seen that not only does my invention make it easier for people to display the national flag both day and night, but it does so at smaller cost, less bother and greater overall energy savings than comparable flag illumination in the past.

SUMMARY OF THE INVENTION

To enable legal twenty-four hour national flag display, to permit night display of vehicle-mounted school and team flags, and to do either with minimal increase in night sky light pollution, I mount a light source immediately adjacent a flag and direct the light essentially directly toward the flag, rather than upwardly into the sky. Preferably, the light source is provided within a transparent portion of the flag-mounting pole, and is ideally focused directly toward the flag by a reflector which is adapted to shift positions with changes in flag positions due to directional changes of air flow across the flag.

It is a principal object of the invention to provide for illuminating a flag from immediately adjacent its suspended end with minimal upwardly-directed light pollution of surrounding sky.

More specifically, an object is to concentrate the illumination by providing for reflector-focusing of light from a source thereof directly and essentially radially toward the flag.

A still further object is to maintain light focus directly toward a flag irrespective of airflow directional changes across the flag.

In a pole-mounted flag, an object of the invention is to mount a flag in part on a halyard truck that is pivotal in response to wind direction changes across the flag, and to mount a reflector to pivot in unison with the truck in order to maintain reflected light focus toward the flag at all times.

In a vehicle-mounted flag, an object is to allow for pivotal movement of a flag about its pole and to maintain illumination of the flag in any position to which the flag may move.

More specifically in connection with the immediately-preceding object, it is an object to provide a reflector responsive to flag directional changes to maintain focal direction of illumination toward the flag at all times.

Other objects and advantages will become apparent from the following description, in which reference is made to the accompanying drawings.

BRIEF DESCRIPTION OF THE DRAWINGS

FIG. 3 is a lower cross-sectional view of the flagpole of FIG. 1 at a level a few feet above ground level, illustrating winch mechanism for manually hoisting and lowering a flag as well as mechanism for raising and lowering an internal light source to enable bulb changing when necessary.

FIG. 4 is a cross-sectional fragmentary vertical view of a type of my invention useful for exhibiting a school or team flag atop a vehicle.

FIG. 5 is a cross-sectional view of the flag mount of FIG. 4, and is taken along lines 5—5 of FIG. 4.

DETAILED DESCRIPTION OF THE PREFERRED EMBODIMENTS

Figure 1:
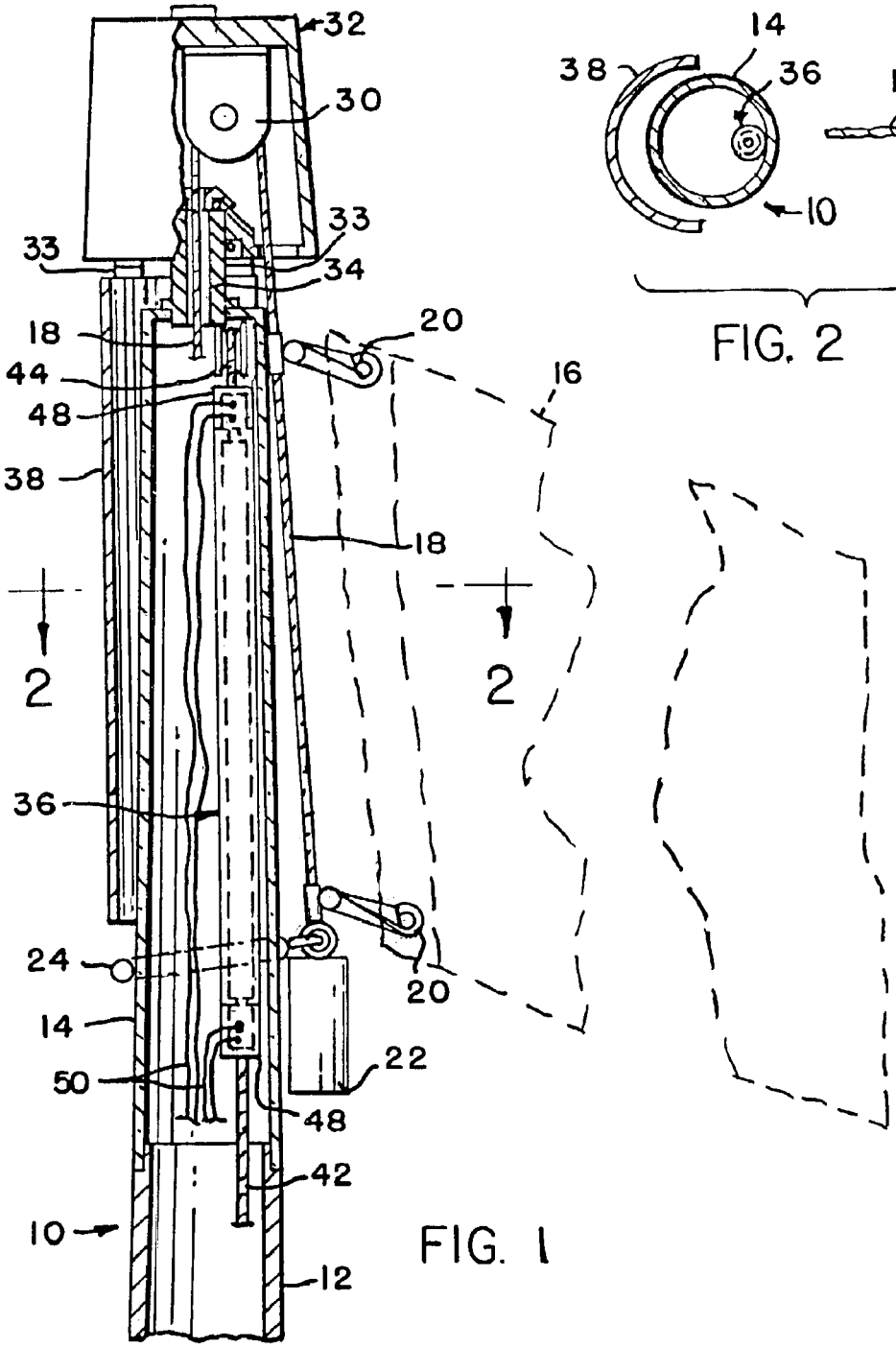
FIG. 1 is a fragmentary, cross-sectional generally vertical view of a stationary flagpole illustrating its key components.

FIG. 1 shows the upper or top section of a permanent flagpole 10 having a metallic tubular portion 12 for its principal length and a transparent plastic tubular portion 14 mounted atop the portion 12. The portion 14 is of a length at least somewhat exceeding the height of a flag 16. Portion 14 securely interfits the portion 12 in a manner providing a smooth continuation of the exterior surface of the two tubular portions. While FIG. 1 shows the flagpole 10 as being vertical and may be referred to in that manner, it should be understood that the flagpole 10 may be angled and may be either ground or building mounted.

The left end of flag 16 is suspended from a line or halyard 18 by any means such as swivel hooks 20 applied to the halyard 18. In addition, a counterweight 22 and a beaded retainer ring 24 may be supported at the extended end of the halyard 18 to maintain the suspended end of the halyard 18 and flag 16 taut and closely adjacent the flagpole. The remote end of the halyard 18 is wound about a winch spool 26 (FIG. 3) at the lower end of the flagpole. The spool is rotatably mounted at approximately waist height in pole portion 12 so that a person can engage a hand crank (not shown) into a socket 28 and raise or lower the flag 16 for installation and removal of a flag as desired. It will be noted that FIGS. 1 and 3 represent two extremes of halyard positions. When flag 10 is at the top of the pole as in FIG. 1, the halyard portion wound about the winch spool would fully occupy the spool. FIG. 3 shows the halyard 18 almost completely unwound from the spool 26, meaning that the flag 16 and its supporting elements and counterweight 22 are at their lowermost ground-level positions for attaching or detaching the flag. The halyard 18 is trained over a pulley system 30 supported in a truck 32 which is freely rotatable on an axle 34 mounted in the top end of the transparent portion 14 of the flagpole 10.

Figure 2:
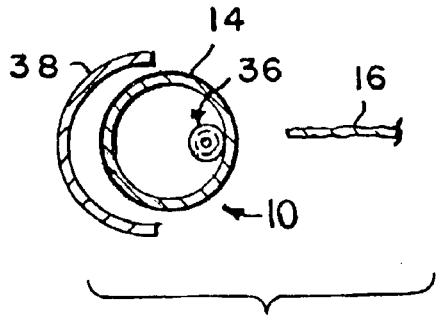
FIG. 2 is a cross-sectional view taken essentially along lines 2—2 of FIG. 1.

With the exception of the transparency of the portion 14, what has been described thus far in conventional for many, if not most, ground-positioned flagpoles. What is novel herein is that a light source 36, in the design in FIGS. 1 and 2 shown as being in the form of an elongated fluorescent tube, provides illumination for the flag 16 through the transparent portion 14 of the pole. Preferably, as shown best in the cross-sectional view of FIG. 2, a semi-cylindrical or parabolic reflector 38 at the exterior of the transparent portion 14 is mounted on the side of the light source 36 opposite that of the flag 16. Thus, light from the fluorescent tube is direct from the tube toward the flag and at the same time is reflected from a highly-reflective inside surface of the reflector 38. Focus of light is thus directed along the flag 16 on both sides thereof from its suspended end adjacent pole 10 toward its free end at the extreme right of FIG. 1. The fluorescent tube may be of a length equal to the height of the flag.

When wind and flag directions change, in order to maintain light focus, it is necessary to have reflector 38 keep a constant diametrically-opposite relationship with that of the flag 16. In the illustrated embodiment, I best accomplish this by securing the reflector 38 to depend downwardly from the revolving truck 32 by means of brackets 33. As the flag responds to a change in wind direction, it pivots the pulley system 30 and truck 32 with it about the axle 34. Being directly affixed to the truck, the reflector 38 likewise moves about pole 10 to the same extent as flag 16.

For lowest energy cost and longest life of the light source, it is preferably automatically activated to its "on" condition only under low light conditions by customary light-sensitive switching controls (not shown). It will also be seen that the light direction is generally horizontally toward the flag, and not projected upwardly into the night sky as is common when illuminating a flag from ground-positioned spotlights.

Because the bulb of light source 36 must be replaced occasionally, I provide for moving the light source 36 between its active position shown in FIG. 1 and a replacement position adjacent the winch spool 26 at ground level, as shown in FIG. 3. An elongated opening 40 with a removable cover plate (not shown) is provided for installing and removing the fluorescent tube from a continuous loop cable 42 trained over a pulley 44 at the top in FIG. 1 and a corresponding pulley 46 in FIG. 3. The fluorescent tube can have its opposed tube-receiving sockets 48 mounted to cable 42 in any fashion which maintains their respective positions and distance firmly for securing the tube in place on the cable. Electrical wiring 50 travels with the tube when moved along the cable 42. Assuming the tube is to be replaced, the cover plate over the opening 40 is first removed to gain access to the interior of the pole 10. A plug section 52 connected to wiring 54 is then disconnected from a mating plug section connected to wiring 50. The wiring 54 leads to a ballast 56 connected by wiring 58 to a source of electricity. Once plug 52 is disconnected, the cable 42 can be manually pulled down on the side containing the fluorescent tube. One end of plug 52 attached to wiring 50 is secured to the cable 42 and it and its wiring 50 move upwardly to follow cable 42 as the light source 36 is lowered. Upon fluorescent tube replacement through the opening 40, the cable is manually pulled on its opposite side to raise the new light source into position adjacent the flag. At the same time, the mating section that connects with the plug 52 is lowered back to the position of FIG. 3. The wiring 54 can be reattached to wiring 50 at the plug 52, the opening 40 closed and the entire system is now back in operation with a new light source. The wiring 58 may be connected to a photosensitive switch to energize the light source under conditions when needed. It can be seen that the flag 16 may be exhibited on a permanent basis, so long as the light source 36 remains in working condition. The need and time required for daily raising and lowering the flag is obviated. The United States Code recommends that the flag not be displayed when weather is inclement. Also, if for any reason the flag must be lowered for replacement due to tearing or weather shredding, lowering can be accomplished without affecting the flag illumination system. The two systems are totally independent. If desired, controls can be added to make the lighting system ineffective whenever the flag has been lowered or removed.

It should be understood that a permanent flagpole such as the pole 10 of FIGS. 1–3 may also be constructed as a telescoping unit in which, instead of hoisting the flag by means of a halyard and winch, moveable extensions of the pole may be raised, lowered and locked in their final positions. In that design, I can readily use a telephone-type helical spring-like wiring cord to extend and retract the wiring for the light source.

Referring now to FIGS. 4 and 5, I here illustrate the basic principles of flag illumination adapted to use with a vehicle such as an automobile or pick-up truck. College team flags are commonly displayed in many parts of the country as a matter of pride when attending sporting events. Some of those events are gone to or returned from in hours of darkness or overcast skies when illumination of the flag may be desirable.

When traveling, the flag 60 would normally extend rearwardly of the vehicle. But when stopped or moving slowly in heavy traffic, the flag would be wind-direction dependent. I can provide any of several different types of means for mounting a shaft 62 to a window of the vehicle. Wiring 64 may be connected to plug into a conventional dashboard cigar lighter (not shown). The particular power source is immaterial, since the illuminated system of FIGS. 4 and 5 may be battery operated as well.

A hollow transparent tube 66 supports end plugs 68 for a fluorescent tube 70, with electrical wiring passing through the interior of the hollow tube 66 to the two plugs 68. A collar 72 is fixed to the top of the hollow tube 66 by a screw or screws 74. An upper rotatable collar 76 and a lower rotatable collar 78 are both freely journaled on the exterior surface of tube 66. These two collars 76 and 78 are interconnected by a semi-cylindrical reflector 80 that is similar in function and maintenance of relationship to the flag 60 as in the design of the FIGS. 1–3 embodiment. Screws 82 fasten the reflector 80 to the collars 76 and 78. The flag 60 is preferably provided at its suspended end with a full-height loop 84 in which a rod 83 is received. Rod 83 is secured at its top and bottom to rotatable collars 76 and 78 respectively. A lower collar 86 is secured to the transparent tube 66 by means of a screw or screws 88. The rotatable 78 collar rests against the upper surface of the lower collar 88. Enough play should be allowed to enable free rotation of the flag 60 and its associated movable parts about tube 66. It is apparent that air flow direction changes across the flag 60 will cause the rod 83 to move circumferentially about the axis of the tube 66. In so doing, the collars 76 and 78 and the reflector 80 follow the rod 83 movement and maintain light focus from the tube 70 toward the flag 60, irrespective of the angular repositioning of the flag 60 about tube 66.

It is feasible to adapt the principles disclosed herein into flags that are manually carried as well as those that are permanent or carried by a moving vehicle. Various other changes may be made in the design details without departing from the spirit and scope of the claims.

I claim:

1. A device for illuminating a flag under low-light conditions, comprising:

a a generally tubular upstanding pole at least an upper length portion of which is stationary and light-transmitting about 360 degrees of its axis;

b a non-rotatable light source within said light-transmitting pole portion;

c a flag having a suspended end adjacent said light-transmitting portion and a free end remote from the suspended end, the height of said flag suspended end being at least as great as said light-transmitting pole portion and said flag being freely movable generally circumferentially about said pole in response to changes in wind direction across the flag surfaces;

d a rotatable element atop said upper length pole portion for mounting at least a portion of the flag suspended end;

e said flag extending essentially in a radial direction toward a downwind side of said pole in response to air flow across said pole, and f a light-reflecting element having a reflective surface facing the flag and being operatively associated with said rotatable element to rotate therewith whereby to continuously focus light from said light source through said light-transmitting portion and toward said flag irrespective of air flow direction changes that may cause the flag to move about said pole.

2. A device according to claim 1 wherein said light-reflecting element is mounted exteriorly of said light-transmitting pole portion.

3. A device according to claim 1 wherein said light source comprises an enlongated tubular element essentially of a length equal to the height dimension of said flag, wherein said pole is permanently ground-mounted and extends higher than the reach of a person at ground level, and wherein said light source is supported internally of said pole and is mounted on a conveying cable that is capable of raising and lowering said light source relative to said ground level and the position at which said flag is displayed.

4. A device according to claim 3 wherein an access opening is provided in said pole adjacent the ground level to enable light source replacement, and means adjacent the access opening for electrically connecting and disconnecting said light source relative to a fixed ground level supply of electricity.

5. A device according to claim 1 wherein said pole is portable and mountable atop a passenger road vehicle.

6. A device according to claim 5 wherein said light-transmitting pole portion supports a pair of vertically-spaced freely rotatable collars, and wherein a rod extending between and affixing said collars to each other suspends said flag therefrom.

7. A device according to claim 6 wherein a semi-cylindrical light reflector interconnects said freely-rotatable collars diametrically-opposite to said rod whereby to maintain light-directing focus toward said flag irrespective of its rotational position about said light-transmitting pole portion.

8. A device for illuminating a flag under low-light conditions, comprising:

a a generally tubular upstanding pole at least an upper length portion of which is stationary and light-transmitting about 360 degrees of its axis;

b a non-rotatable light source within said light-transmitting pole portion;

c a flag having a suspended end adjacent said light-transmitting pole portion and a free end remote from the suspended end, the height of said flag suspended end being at least as great as said light-transmitting portion and said flag being freely movable generally circumferentially about said pole in response to changes in wind direction across the flag;

d a rotatable element atop said pole for mounting an upper corner of the flag suspended end;

e said flag extending essentially in a radial direction toward a downwind side of said pole in response to air flow across said pole and movement of said rotatable element with said flag;

f said pole being permanently ground-mounted and extending higher than the reach of a person at pound level; and g a vertically-extending conveying cable supporting said light source and being capable of raising and lowering said light source relative to said ground level and the position at which said flag is displayed whereby to enable access of said light source for maintenance purposes.

* * * * *